US005839958A

United States Patent [19]

Ozarow

[11] Patent Number: 5,839,958

[45] Date of Patent: Nov. 24, 1998

[54] VOICE SYNTHESIZED BRIDGE BIDDING MODULE AND METHOD OF USING SAME

[76] Inventor: Ruth Ozarow, 373 Fearrington Post, Pittsboro, N.C. 27312

[21] Appl. No.: 803,691

[22] Filed: Feb. 24, 1997

[51] Int. Cl.[6] ..... A63F 9/22

[52] U.S. Cl. ..... 463/35; 463/11; 463/47; 273/148 R

[58] Field of Search ..... 463/11, 47, 16, 463/35, 37, 31, 30, 40; 273/148 R, 148 B, 148 A

[56] References Cited

U.S. PATENT DOCUMENTS

| | | | |
|---|---|---|---|
| 3,420,526 | 1/1969 | Berger . | |
| 4,030,764 | 6/1977 | Mattos | 273/148 R |
| 4,092,026 | 5/1978 | Barbier . | |
| 4,093,215 | 6/1978 | Ballard | 463/11 X |
| 4,373,719 | 2/1983 | Nelson et al. | 463/11 |
| 5,200,890 | 4/1993 | Pionchon | 463/11 |
| 5,240,249 | 8/1993 | Czarnecki | 463/11 |
| 5,397,133 | 3/1995 | Penzias | 273/148 R |
| 5,482,275 | 1/1996 | Grinoch et al . | |
| 5,743,797 | 4/1998 | Jannersten | 463/11 |

*Primary Examiner*—Michael O'Neill

*Attorney, Agent, or Firm*—Daniel Robbins

[57] ABSTRACT

Each of the four players of a game of contract bridge are provided with an identical battery operated module containing switches which a player uses to enter bids of from 1 to 7 in "Spades", "Hearts", "Diamonds", "Clubs" or "No-Trump", according to the rules of the game. Additionally there are switches for signalling, "Pass", "Double", and "Re-Double". After entering a bid via the switches of a player's module, an internal microcontroller decodes the switch values and generates the bid's digital representation which is stored in RAM, and is also input to an internal voice synthesizer. The voice synthesizer drives a small loudspeaker mounted in the module which outputs a verbal message audible to all the players which is the linguistic expression of the selected bid. The verbal message's expression is free of all oral mannerisms, and is determined solely by the electromechanical characteristics of the voice synthesizer. The bidding is then continued by the other players using their modules in a similar manner until a contract is reached. Each bidding sequence is stored in the microcontroller of each individual module allowing a review of the bidding at the conclusion of a hand. A "Clear" control erases the bidding data from the microcontroller memory prior to the dealing of a new hand. A "Cancel" button allows the erasure of an incorrect bid from RAM.

16 Claims, 2 Drawing Sheets

VOICE SYNTHESIZED BRIDGE BIDDING MODULE AND METHOD OF USING SAME

BACKGROUND OF THE INVENTION

1. Field of the Invention

This invention relates to the game of contract bridge, and in particular, to a device and method for registering and expressing the bidding in a contract bridge game.

2. Description Relative to the Prior Art

Bridge is among the most popular of participant games in the United States as well as in many other countries. The Encyclopedia Britannica (15th edition) states: "It has spread all over the world and constitutes a social phenomenon that in some respects is unparalleled in the history of games. It is estimated that there are 100 million bridge players throughout the world." Among these players the level of play ranges from relaxed, recreational play to intense, sophisticated play as exemplified by duplicate bridge competitions and tournaments.

It has long been a matter of concern among bridge enthusiasts that unauthorized information may possibly be transmitted between partners by voice intonation, inflection or other oral mannerisms during the critical verbal bidding process. In the prior art, this problem has been addressed by disclosure of non-verbal bidding devices such as player actuated visual mechanical or electrical displays which sequentially disclose the bidding in a visual, rather than a verbal manner. Such a mechanical device is disclosed in U.S. Pat. No. 5,482,275 issued to Grinoch et al., while an electrical display device is disclosed in U.S. Pat. No. 3,420, 526 issued in the name of L. S. Berger.

It will be appreciated that such visual bidding devices introduce a new dimension into the game not present in the traditional verbal bidding process. That is, the time-honored orally spoken and aurally heard bids are replaced by a new and unfamiliar bidding regimen introducing an unanticipated and unforeseeable variation into the classical game. The present invention solves the problem of the unauthorized transmission of information during bidding while retaining the game's universally followed verbal expression of the bids.

SUMMARY OF THE INVENTION

Each of the four players of a game of contract bridge are provided with an identical battery operated module containing switches which a player uses to enter bids of from 1 to 7 in Spades, Hearts, Diamonds, Clubs or No-Trump, according to the rules of the game. Additionally there are switches for signalling, Pass, Double, and Re-Double. After entering a bid via the switches of a module, the bid is transferred to an internal microcontroller. The microcontroller converts the value of the bid to a digital representation, stores this digital value in the microcontroller's RAM, and inputs the digital value to an internal voice synthesizer. The voice synthesizer drives a small loudspeaker mounted in the module which outputs a verbal message audible to all the players which is the linguistic expression of the selected bid. If a player has made a mistake in manually entering his bid, the bid will have already been vocally output when the player actuated his selector switches. The player then actuates a "Cancel" button which erases his last bid from RAM, and he may then re-enter a corrected bid. The verbal messages' expressions are free of all oral mannerisms, and are determined solely by the electromechanical characteristics of the voice synthesizer. The bidding is continued by the other players using their modules in a similar manner until a contract is reached. Each bidding sequence is stored in the microcontroller of each individual module allowing a review of the bidding at the conclusion of a hand. A "Review" button on each module, actuated in turn by each player, causes the sequential verbal readout of the hand's bidding. A "Clear" control on the module erases the bidding data from the microcontroller memory prior to the start of a new hand.

BRIEF DESCRIPTION OF THE DRAWINGS

The invention will be described with respect to the figures of which.

DESCRIPTION OF THE PREFERRED EMBODIMENTS

Figure 1:
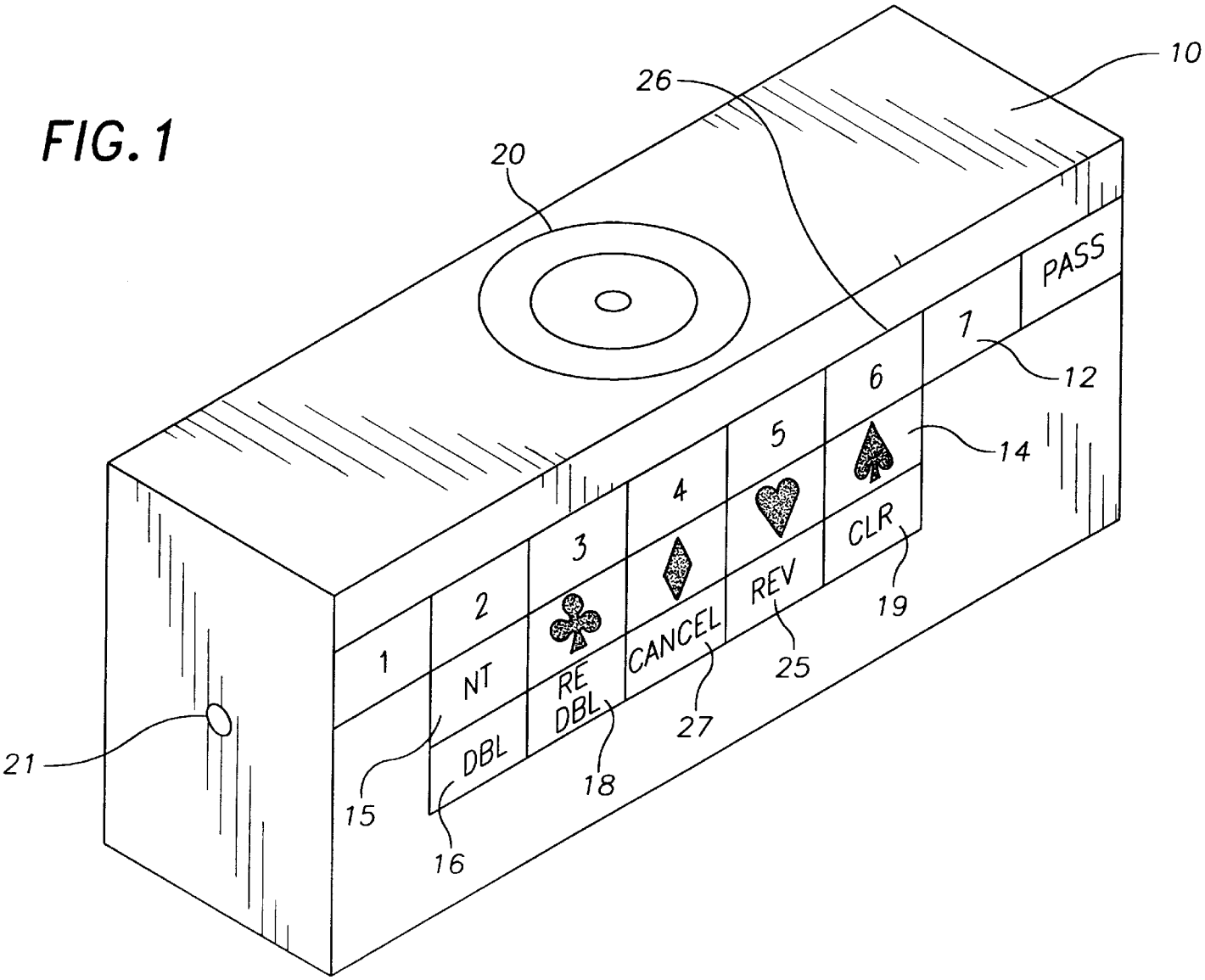
FIG. 1 is a drawing of a bidding module of the invention.

Referring to FIG. 1, each player is provided with a bidding module 10, containing push button switches, e.g. 12, for inputting the player's numerical bid value, or to "Pass". The suit designation is also input by means of one of the suit switches, e.g. 14, or a "No-Trump" switch 15. There are also a "Double" switch 16, and a "Redouble" switch 18 mounted in the module 10. A bidder depresses the switches for a selected bid value and a selected suit, and the selections are digitally encoded and stored in the RAM of an internal microcontroller 22. If a player selects the "Double" switch 16 or "Redouble" switch 18 that information is also stored in the microcontroller.

Figure 2:
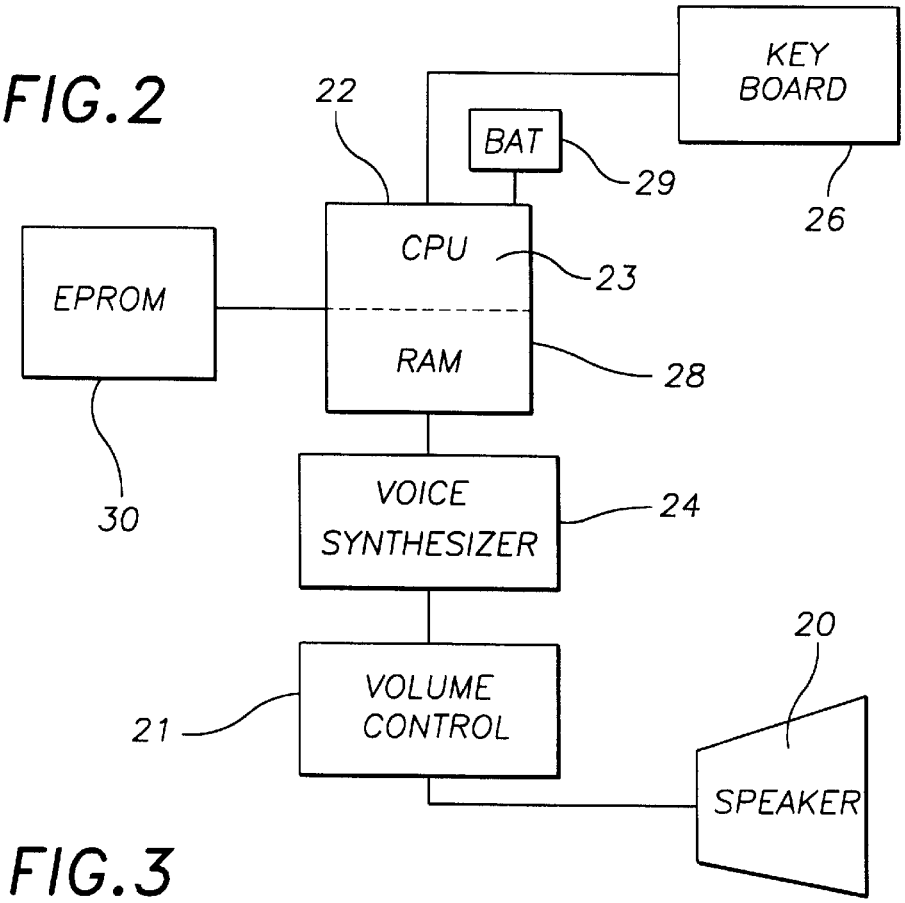
FIG. 2 is a block diagram of the elements of the module of FIG. 1.

Referring to FIG. 2, the keyboard 26 contains the switches described above in connection with FIG. 1. When data is input through the keyboard 26, the microcontroller 22 initiates a key scan program subroutine utilizing its internal CPU 23 to identify and digitize the value of the selected key. The digital representation of the keyed data is stored in RAM memory 28 (which may be a semiconductor device separate from the microcontroller 22), under control of the program of the microcontroller 22. This operating program is stored in an EPROM 30 which may be internal or external to the microcontroller 22. The digital representation of the keyed data is also transferred to a voice synthesizer 24. The voice synthesizer 24 is a self contained semiconductor device which accepts digital data representing voiced signals, and under control of an internal microcomputer and memory converts the digital signals to their analog equivalents. The analog output of the voice synthesizer 24 feeds a loudspeaker 20 via a volume control 21. It will be noted that the synthesized voice output is of uniform sound quality, and provides no information other than the spoken bid itself.

In the case of a bidding error, a "Cancel" switch actuates a subprogram to erase the last stored bid data from RAM. Other program subroutines in the microcontroller 22 memory allows the verbal replay of the bidding by actuation of the "Review" switch 25, and clearing of all stored bidding values from RAM by means of the "Clear" switch 27.

The vocalized bid may be expressed in a variety of languages, with English as the preferred language.

The microcontroller 22 is preferably a CMOS MC68HC705C8 unit containing 8 bit architecture, on-chip CPU (Central Processor Unit), RAM (Random Access Memory ) and EPROM (Erasable Programmable Read Only Memory), manufactured by Motorola Inc., Phoenix Ariz.

Additional RAM and EPROM memory may be peripherally incorporated to provided expanded memory. The voice synthesizer is preferably a CMOS TMS50C20 synthesizer manufactured by Texas Instruments, Inc., Dallas, Tex., operated under program control of the microcontroller 22. Power is supplied by means of a battery unit 29.

Figure 3:
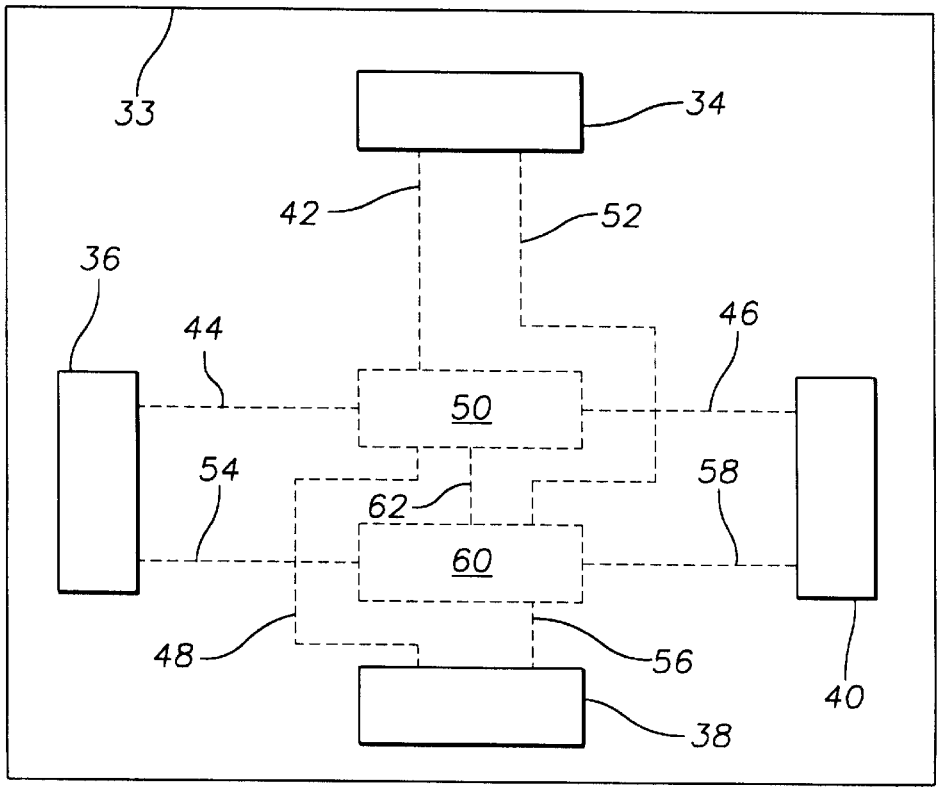
FIG. 3 is a block diagram of a second embodiment of the invention.

In a second embodiment of the invention shown in FIG. 3, four bidding modules 34,36,38,40 are mounted on a conventional bridge table top, 33. The bidding modules 34,36,38,40 are identical to the bidding module 10 shown in FIG. 1, except the modules 34,36,38,40 do not have internal individual microcontrollers 22 and voice synthesizers 24 (FIG. 2). Instead, each module 34,36,38,40 is connected by digital data and address lines 42,44,46,48 to a central microcontroller 50 and by analog voice data lines 52,54,56, 58 to a central voice synthesizer 60 mounted under the bridge table top, 33. The microcontroller 50 and the voice synthesizer 60 have interconnecting digital address lines, digital data lines and power buses, 62.

The interconnections between any one of the bidding modules 34,36,38,40 and the central microcontroller 50 and central voice synthesizer 60 are identical to that shown in FIG. 2. The microcontroller 60 is programmed to sequentially accept inputs from each of the bidding modules 34,36,38,40, and to activate the central voice synthesizer to transmit the voiced bid over the appropriate analog voice data line 52,54,56,58 to the speaker of the appropriate module, as previously explained.

The "Review", "Clear" and "Cancel" switches also operate as described for the independent bidding module 10, as described above.

The invention has been described in detail with particular reference to preferred embodiments thereof, but it will be understood that variations and modifications can be effected within the spirit and scope of the invention. For example, the microcontroller and its associated memories may be incorporated into a single chip with the voice synthesizer.

What is claimed is:

1. Apparatus for use in bidding of a bridge game, comprising:

a) a module including means for entering a bridge bid, b) means for converting said bridge bid to a digital representation, c) means for storing said digital representation, and d) means for converting said digital representation to a vocalized linguistic output whereby said bid is audibly transmitted from said module.

2. The apparatus of claim 1 wherein said means for entering said bridge bid comprise selector switches.

3. The apparatus of claim 1 wherein said means for converting said bridge bid to digital representation comprises a digital microcontroller.

4. The apparatus of claim 1 wherein said means for storing said digital representation is a RAM (Random Access Memory).

5. The apparatus of claim 1 wherein said means for converting said digital representation to a vocalized linguistic output is an electronic speech synthesizer.

6. The apparatus of claim 5 wherein said vocalized linguistic output is audibly generated by a loudspeaker.

7. The apparatus of claim 6 wherein said linguistic output is in the English language.

8. A bridge bidding system comprising:

a) four modules each comprising means for entering a player's bridge bids, b) single unified means not integral with said modules for converting each of said bridge bids to digital representations, c) single unified means not integral with said modules for storing said digital representations, d) single unified means not integral with said modules for converting said digital representations to vocalized linguistic outputs, whereby each of said bids is audibly transmitted.

9. The apparatus of claim 8 wherein said means for entering said bridge bids comprise selector switches.

10. The apparatus of claim 8 wherein said means for converting said bridge bids to digital representations comprises a digital microcontroller.

11. The apparatus of claim 8 wherein said means for storing said digital representations is a RAM (Random Access Memory).

12. The apparatus of claim 8 wherein said means for converting said digital representations to vocalized linguistic outputs is an electronic speech synthesizer.

13. The apparatus of claim 12 wherein said vocalized linguistic outputs are audibly generated by at least one loudspeaker.

14. The apparatus of claim 13 wherein said linguistic outputs are in the English language.

15. A method of expressing bids in a bridge game, comprising the steps of:

a) manually entering bids by means of a keyboard at a player's position, b) converting said bids into digital representations by means of a digital microcontroller, c) storing said digital representations in RAM, d) converting said stored digital representations into vocalized linguistic expressions, and e) audibly transmitting said linguistic expressions by loudspeaker means.

16. The method of claim 15 wherein said converting said stored digital representations into vocalized linguistic expressions is converting said stored digital representations into the English language.

* * * * *